114-253 SR
2/3/87 OR 4,640,213

United States Patent [19]
Lugo

[11] Patent Number: 4,640,213
[45] Date of Patent: Feb. 3, 1987

[54] SIGNAL FLAG APPARATUS FOR WATER SKIING

[76] Inventor: Steven H. Lugo, 5157 W. Joan de Arc, Glendale, Ariz. 85304

[21] Appl. No.: 691,282

[22] Filed: Jan. 14, 1985

[51] Int. Cl.[4] ..... G08C 5/00
[52] U.S. Cl. ..... 114/253; 114/252; 441/68; 200/DIG. 26
[58] Field of Search ..... 441/68, 73; 114/242, 114/247, 249, 252, 253; 116/35 R, 28 R, 173; 280/480; 340/127, 138, 286 R; 43/16, 17; 248/147; 200/52 R, 153 R, DIG. 26

[56] References Cited

U.S. PATENT DOCUMENTS 3,602,188 7/1971 Penaflor ..... 116/173
3,735,724 5/1973 Miller ..... 116/303
3,786,778 1/1974 Palmer ..... 116/313
3,798,631 3/1974 Langford ..... 340/502
4,090,468 5/1978 D'Spain ..... 116/173
4,122,796 10/1978 Pressler ..... 114/343

*Primary Examiner*—Galen L. Barefoot
*Assistant Examiner*—C. T. Bartz
*Attorney, Agent, or Firm*—Herbert E. Haynes, Jr.

[57] ABSTRACT

A signal flag apparatus for mounting on a boat that is towing a water skier, with the apparatus being operable to raise a warning flag when the water skier falls. The signal flag apparatus is an automatic mechanism which holds the warning flag down when the skier applies a tension on the tow rope and will quickly raise the flag in the absence of skier applied tension.

14 Claims, 7 Drawing Figures

SIGNAL FLAG APPARATUS FOR WATER SKIING

BACKGROUND OF THE INVENTION

1. Field of the Invention

This invention relates generally to the sport of water skiing and more particularly to an automatic system for raising a warning flag when a skier goes down.

2. Description of the Prior Art

The sport of water skiing is very popular and, as is widely known, it is carried out by a motorboat towing a person on water skis. A skier tow line is affixed to the stern of the boat and the skier grasps a handle on the free end of the two line so as to be towed across the surface of the water.

As in virtually all sporting activities, the sport of water skiing has certain dangerous aspects. Aside from the physical danger of falling, the skier is often subjected to the danger of injury by other boats in the vicinity. While there is a relatively samll likelihood of collision between another boat and a skier that is being towed, when the skier goes down, his visibility decreases drastically and the chances of his being run over by another boat are substantially increased.

Due to the ever increasing popularity of water sports in general, the lakes and waterways are becoming more congested and this results in greater hazzards to a downed water skier.

The problem relating to the safety of downed water skiers has long been recognized and water safety regulations have been enacted to alleviate this problem. Whenever a boat is towing a water skier, it is required that at least two (2) persons be in the boat, one to operate the boat and another to act as an observer. The observer's duty is to watch the skier and when he goes down, the observer raises a warning flag and notifies the boat's operator so that he can commence the operations required to pick up the downed skier. The warning flag is to be held up as long as the downed skier is in the water.

Several devices and systems, as will hereinafter be described, have been proposed to automatically accomplish the observers duties. But, by far the most commonly used technique is to rely solely on the observer. In many instances, observers are very conscientious and attentive to their duties. However, due to the relaxed nature, and partying that is sometimes associated with water activities, some observers are less attentive than they should be. Further, when an observer is holding the warning flap up, his usefullness in accomplishing other tasks, such as helping to pick up the downed skier, is negated.

As mentioned above, several prior art devices and systems have been suggested to facilitate the use of the warning flag when a water skier goes down.

U.S. Pat. Nos. 3,786,778; 4,090,468; and 4,122,796 all relate to flag raising mechanisms that are operated by the observer, or the boats operator, to raise and hold the warning flag in the up position when the skier goes down.

U.S. Pat. No. 3,798,631 discloses an alarm system whcih is automatically triggered to produce an audio and/or visual alarm when the skier goes down. When the alarm is produced, a warning flag must be places in a special socket to shut off the alarm.

U.S. Pat. Nos. 3,602,188; and 3,735,724 disclose systems for automatically raising the warning flag when the skier released his grip on the tow line.

While the foregoing prior art devices accomplish, in varying degrees, the purpose of the present invention, they fall short of being totally satisfactory, or desirable, in a number of respects. The manually operated devices of U.S. Pat. Nos. 3,786,778; 4,090,468; and 4,122,796, all rely on the attentiveness of the boat's observer, and thus are only as reliable as the observer. The semi-automatic prior art device of U.S. Pat. No. 3,798,631 and the fully automatic devices of U.S. Pat. Nos. 3,602,188 and 3,735,724, are relatively complex and costly mechanisms.

All of the above described prior art devices require that at least some of their structural elements, such as flag containing standards, pivot housings, and the like, be mounted on the deck or gunwales of the tow boat. Many boat owners are reluctant to mount anything on the deck or gunwales of their boats for aesthetic reasons. In many boating activities, both water skiing and otherwise, persons in the boat will often need to walk on the deck or crawl over the gunwales when getting into or out of a boat. Thus, any bostructions, such as the above mentioned hardware, that are mounted on the deck or gunwales can be safety hazzards. This, in conjunction with the aesthetics, costs and complexity of the prior art devices has kept many boat owners from utilizing such devices.

Therefore, a need exists for a new and improved safety flag device for use on boats that are employed inw ater skiing, with the device of the present invention overcoming some of the problems and shortcomings of the prior art.

SUMMARY OF THE INVENTION

In accordance with the claimed invention, a new and improved signal flag apparatus is disclosed for use on boats that are employed for towing water skiers. The device is designed for mounting on the transon of the ski boat so as to alleviate some of the prior art aesthetic concerns and safety problems associated with mounting structures ont eh deck and gunwales of boats. The device includes a pivot structure to which a flag is demountably attached and a spring means is employed to bias the pivot structure, and thus the flag, to the elevated position. The spring biased pivot structure is connected by means of a special coupling cable arrangement to the two rope. When a water skier is being towed, his holding onto the tow line will apply a tension on the tow line causing it to extent tautly from the boat. The skier applied tension is also belt on the coupling cable by virtue of its being connected to the two line and the tension pulls the coupling cable so that it also extends tautly from the boat. When the coupling cable moves to its extended position, it will pivotably move the pivot member against the bias applied thereto by the spring means and thereby hold the warining flag in the lowered position. When the skier falls, the tension on both the tow line and the coupling cable is released and the spring means will pivotably move the pivot structure to its normal position thereby raising the warning flag.

Accordingly, it is an object of the present invention to provide a new and improved signal flag apparatus for use on boats that are being employed in towing water skiers.

Another object of the present invention is to provide a new and improved signal flag device of the type described above which is adapted to be mounted on the transom o fa water skier tow boat.

Another object of the present invention is to provide a new and improved safety flag device of the above described type which is held in a flag down position when a water skier is being towed and is automatically and quickly moved to elevate the warning flag when the skier falls.

The foregoing and other objects of the present invention as well as the invention itself, may be more fully understood from the following description when read in conjunction with the accompanying drawings.

Figure 3:
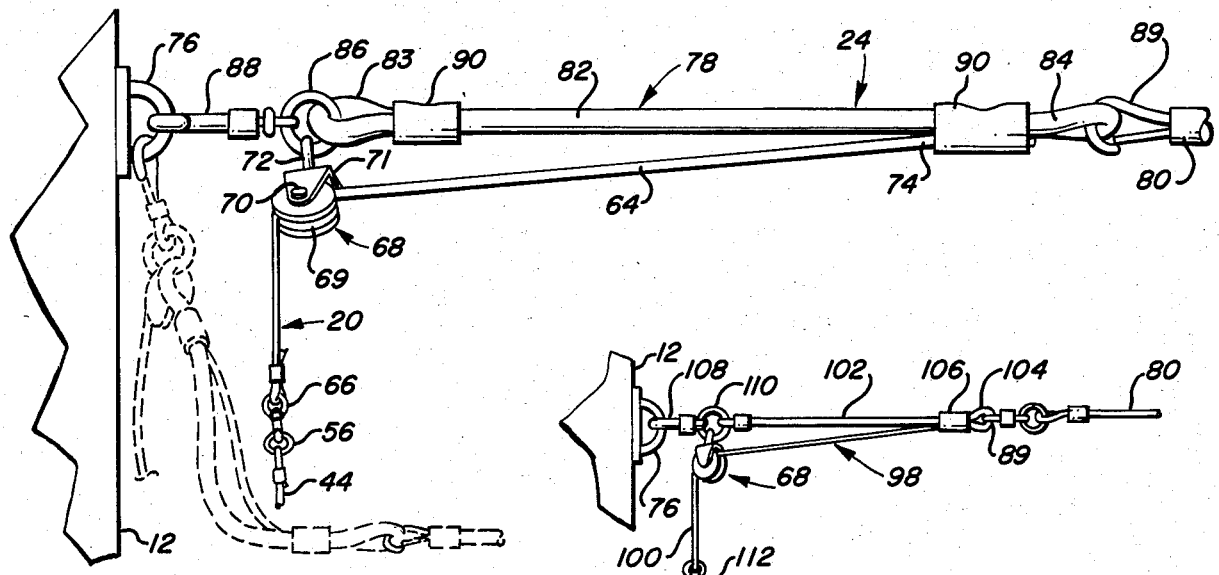
FIG. 3 is an enlarged fragmentary sectional veiw taken along the line 3—3 of FIG. 1.

FIG. *3a* is a view similar to FIG. 3 which shows a first modification of the structure shown in FIG. 3.

FIG. *3b* is a view similar to FIG. 3 which shows a second modification of the structure shown in FIG. 3.

Figure 4:
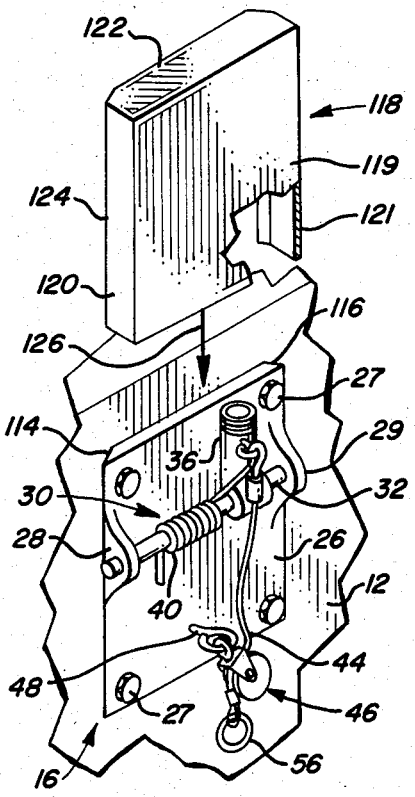

FIG. 4 is a perspective view of one of the structural elements of the present invention with a protective storage cover being shown in exploded relationship therewith.

Figure 5:
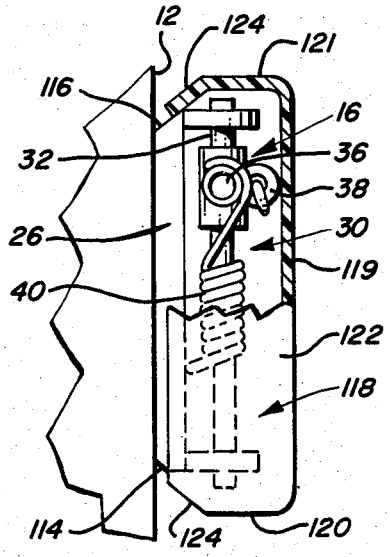

FIG. 5 is a top view of the structure shown in FIG. 4 with the protective cover installed thereon and partially broken away to show the various features of the invention.

DESCRIPTION OF THE PREFERRED EMBODIMENTS

Figure 1:
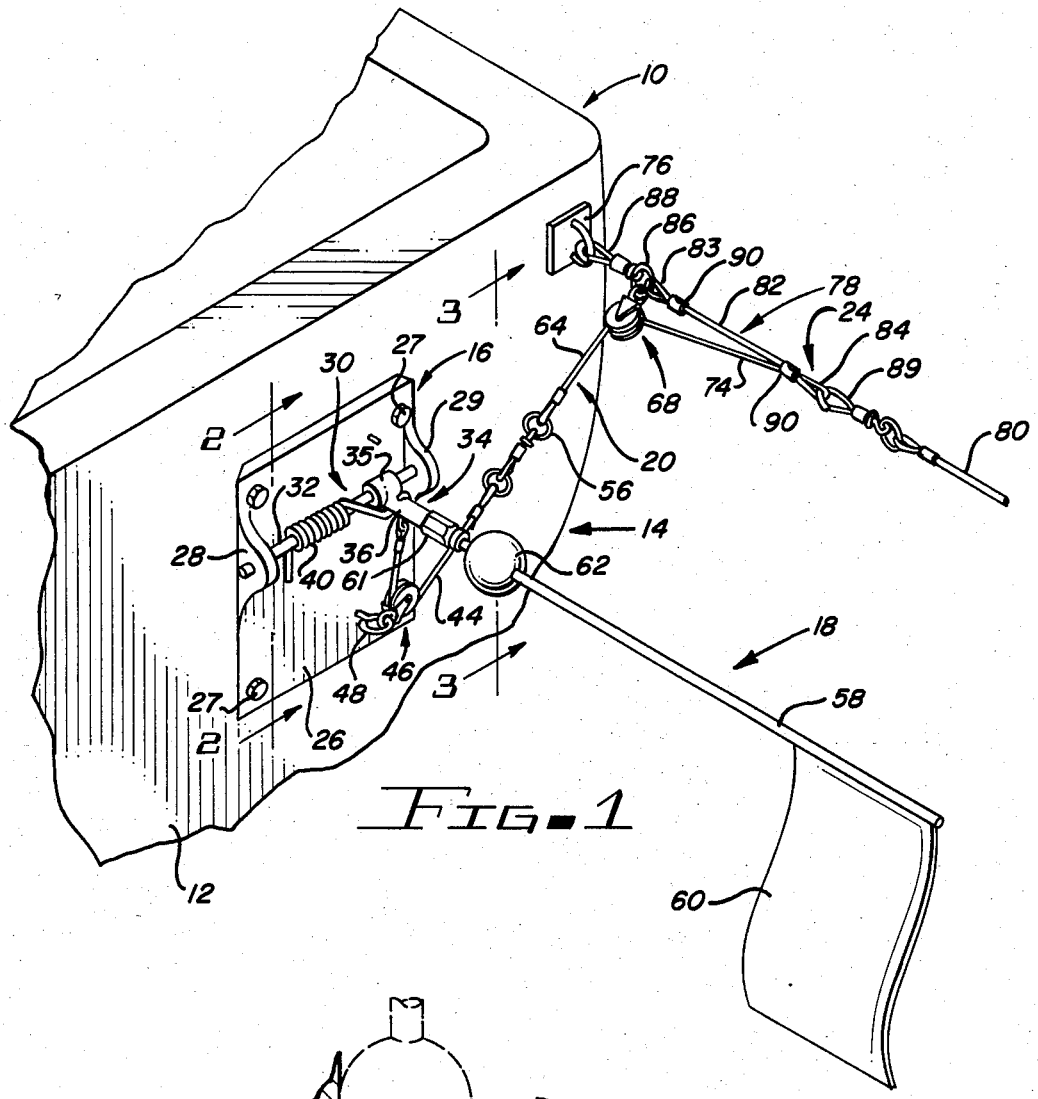
FIG. 1 is a fragmentary perspective view of the stern of a boat having the signal flag apparatus of the present invention mounted thereon.

Referring more particularly to the drawings, FIG. 1 shows the stern of a typical water skier tow boat 10 having the usual transom 12. The automatic skier signal flag apparatus of the present invention is shown as being mounted on the boat's transom 12 and the signal flag apparatus is indicated in it entirety by the reference numeral 14.

As will hereinafter be described in detail, the signal flag apparatus 14 includes the following combination of major elements which are generally referred to as a flag raising mechanism 16, a flag assembly 18, a coupling cable means 20, and a water skier tow line means 24.

Figure 2:
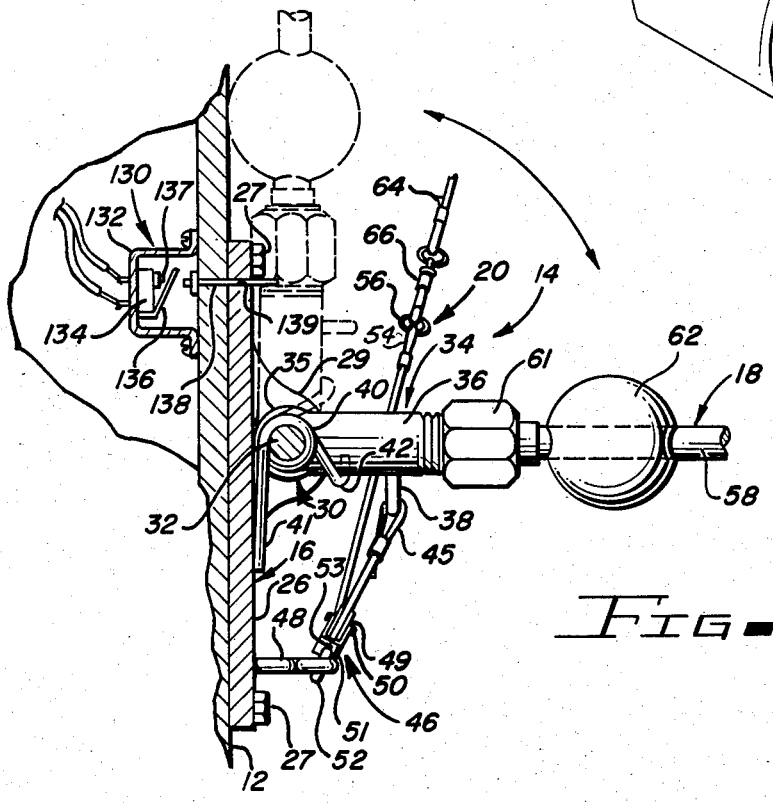
FIG. 2 is an enlarged fragmentary sectional view taken along the line 2—2 of FIG. 1.

The flag raising mechanism 16, as seen best in FIGS. 1 and 2 includes a flat mounting plate 26 which is mounted on the boat's transom 12 such as by the bolts 27. A spaced apart pair of protrusions 28 and 29 are cast, welded, or otherwise formed on the opposite sides of the mounting plate 26, and a pivot means 30 is journaled for rotation about a horizontal axis in suitable bearing means (not shown) provided in the protrusions. The pivot means includes an elongated shaft 32, the opposite ends of which are carried in the above mentioned bearing means (not shown). A T-shaped member 34 is fixedly carried on the shaft 32 for rotation therewith, and that member 34 preferably includes a sleeve 35 which is mounted on the shaft 32 and is suitably attached thereto such as by welding. A stud 36 extends integrally and normally from the sleeve 35 and is thus disposed to extend normally from the shaft 32. The stud 36 has threads formed on it extending end and a ring 38 is welded or otherwise attached thereto so as to extend normally from the stud at a point intermediate the sleeve 35 and the threaded end of the stud.

A torsion spring 40 is wound around the elongated rotatable shaft 32 with one end 41 of the spring extending tangentailly into bearing engagement with the mounting plate 26. The opposite end 42 of the torsion spring 40 extends tangentially therefrom and is looped around the stud 36. The spring 40 is coiled so that it applies a biasing force on the stud 36 to cause the elongated rotatable shaft 32 to rotatably move, and thereby move the stud 36 of the pivot means 30 from its extended substantially horizontal position shown insolid lines in FIG. 2, to its normal substantially vertical position shown in dashed lines in the same figure.

The flag raising mechanism 16 has a leader line 44 mounted thereon one end 45 of which is looped through and affixed in the ring 38 provided on the stud 36 of the pivot means 30. A pulley means 46 is carried on an eyebolt 48 that is welded, or otherwise affixed to the mounting plate 26 at a location below the pivot means 30. The pulley 46 includes a pulley wheel 49 which is rotatably movable about an axle 50 that is carried in a hood 51. A ring 52 is attached ot the hood 51 by means of a pin 53, with the hood, and thus the pulley wheel 49, being free to rotate about the axis of the pin 53. The ring 52 is attached to the above mentioned eyebolt 48, and this, in conjunction with the free rotation of the hood 51 and the pulley wheel 49, allows the pulley means 46 to b emoved in a swivel-like movement into virtuallu any attitude. The leader line 44 passes throught he pulley means 46 and its extending end is fixedly attached, such as by the loop 54 to a ring 56.

As will hereinafter be described in detail, the leader lin 44 forms part of the coupling cable means 20 to move the pivot means 30 between its extended and normal positions.

The flag assembly 18 includes an elongated standard 58 which is provided with a suitable signal flag 60 on one end thereof and has a suitable mounting nut 61 on its opposite end. A resilient spheroid 62, such as a rubber ball or any other bumper means, is mounted on the standard 58 proximate the nut 61. The flag assembly 18 is demountably attached ot the extending threaded end of the stud 36 of the pivot means 30 and is therefore movable therewith.

When the pivot means 30 is held, as will hereinafter be described, in its extended position against the bias applied thereto by the torsion spring 40, the flag assembly 18 will be in a substantially horizontal position and therefore will be in its lower position as seen best in FIG. 1. When the pivot means 30 moves from its extended position to its normal position, the flag assembly 18 will rotatably move with the pivot means 30 through approximately 90 degrees of rotation, and will thus be in its raised substantially vertical attitude. The resilient spheroid 62 is provided to prevent the relatively hard materials of the flag assembly 18 from striking the transom 12 of the boat 10 and marring or otherwise causing damage when the flag assembly 18 moves to its elevated position.

In addition to the hereinbefore described leader line 44, and its associated pulley means 46, the coupling cable means 20 includes an elongated cable 64 having a clasp means 66 fixedly attached to one end thereof. The clasp means 66 is employed to demountably connect the cable 64 to the ring 56 provided on the extending end of the leader line 44. The elongated cable 64 passes through a pulley means 68 which is similar to the hereinbefore described pulley means 46 and is, therefore, provided with a pulley wheel 69 that is rotatable about an axle 70 that is carried in a hood 71. And, the swivel loop 72 is mounted on the hood. Both the pulley means 68 and the extending end 74 of the cable 64 are attached in a special manner to the water skier tow line means 24 as will be fully described below.

As shown best in FIGS. 1 and 3, a loop structure 76 is mounted on the transom 12 of the boat 10. Many boats that are used for water skiing come equipped with such loop structures, usually there ar two loops tructures, one on each side of the transom. The loop structures are provided expressly for demountable coupling of a water skier tow line to the boat, and the illustrated loop structure 76 is used for that purpose.

The preferred embodiment of the water skier tow line means 24 is shown in FIGS. 1 and 3 to include an extension cable means 78 which is used to couple a conventional skier tow rope 80 to the boat 10, and the extension cable means has the pulley means 68 and the extending end 74 of the cable 64 of the coupling cable means 20 attached thereto.

The extension cable means 78 includes a relatively short length of line 82 having a loop 83 formed on its inboard end and a similar loop 84 on its outboard end. The inboard loop 83 has a ring 86 mounted thereon and a clasp means 88 is mounted on the ring for demountable connection of the line 82 to the loop structure 76 provided on the transom of the boat. The swivel loop 72 of the above described pulley means 68 is also mounted on the ring 86. The outboard loop 84 of the extension cable line 82 is for connection, in any suitable manner, to the water skier tow rope 80, such as by means of a suitable clasp 89 provided thereon. The inboard and outboard loops 83 and 84, respectively, are preferably formed by looping the ends of the line 82 back upon themselves and holding them in the looped-over position by means of crimped sleeves 90.

The extending end 74 of the cable 64 of the coupling cable means 20 is fixedly attached to the extension cable means 78 proximate the outboard loop 84 of the line 82. Such fixed attachmen may be accomplished in any suitable manner such as by locating the extending end 74 of the cable 64 in the sleeve 90 which is used to form the outboard loop 84 prior to crimping of that sleeve.

When the boat 10 is operating to tow a water skier, the skier will apply a tension on the water skier tow rope 80 and on the extension cable means 78 and, as a result of this tension, the tow rope 80 and extension cable means 78 will be pulled so as to extend in a taut manner from the boat as shown in solid lines in FIG. 3. When there is no tension on the two rope 80 and the extension cable means 78, indicative of the absence of a water skier being towed, the two rope 80 and the extensionc able means 78 will hang down in a slack position as shown in dashed lines in FIG. 3. When the water skier tow rope 80 and extension cable means 78 are in the taut extended position, the cable 64 of the coupling cable means 20 will also have a tension applied thereto which holds the stud 36 of the pivot means 30 in the extended substantially horizontal position and thereby holds the flag assembly 18 in the lowered position. When the tension is removed from the two rope 80 and the extension cable 78, it will also be removed from the cable 64 of the coupling cable means 20. With the tension removed from the cable 64, the torsion spring 40 will move the pivot means 30 to its normal position which rotates the flag assembly 18 to its elevated position.

Figure 3B:
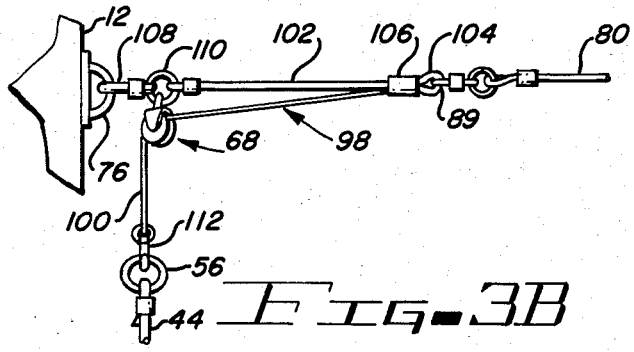
Figure 3A:
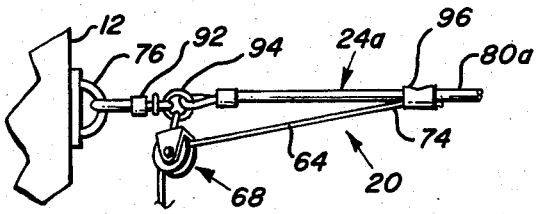

Another way of accomplishing the function of the above described water skier tow line means 24 is illustrated in FIG. 3*a* wherein the water skier tow line means is indicated generally by the reference numeral 24*a*. In this second embodiment, the skier two rope 80*a*, having a clasp means 92 mounted on its inboard end by means of an interconnecting ring 94, is demountably connected directly to the loop structure 76 provided on the boat's transom 12. The extending end 74 of the cable 64 of the coupling cable means 20 is connected to the two rope 80*a* at a location spaced from the clasp means 92 and the ring 94, such as by means of a crimped sleeve 96, and the pulley means 68 of the coupling cable means 20 is connected to the ring 94 in the manner described above.

Still another way of accomplishing the water skier tow line means function is illustrated in FIG. 3*b*. In this third embodiment, an elongated cable 98 is especially configured to provide a control cable segment 100 and an extension cable segment 102. The elongated cable 98 is provided with a loop 104 that is formed therein by using a crimped sleeve 106, for example and the control cable segment 100 and the extension cable segment 102 are separated by the loop 104. The extension cable segment 102 is demountably connected to the loop structure 76 provided on the transom 12 of the boat by means of a suitable clasp 108 that is connected to the extension cable segment 102 by a ring 110. The pulley means 68 of the coupling cable means is connected to the ring 110 in the manner described above. The control cable segment 100 extends from the divider loop 104, passes through the pulley means 68 and is connected to the leader line 44 by a suitable clasp 112, as hereinbefore described. The conventional tow rope 80 is demountably connected to the divider loop 104 such as by means of the clasp 89 provided on the inboard end of the two rope.

Reference is now made to FIGS. 4 and 5 wherein the flag raising mechanism 16 is shown in a non-use state wherein the cable 64 of the coupling cable means 20 has been disconnected from the leader line 44 and the flag assembly 18 has been removed from the stud 36 of the pivot means 30. In this non-use state, the torsion spring 40 will hold the pivot means 30 in its normal state wherein the stud 36 is flat against the mounting plate 26.

The mounting plate 26 is formed with beveled side edges 114 and 116 that are formed in a manner so that the side edges 114 and 116 slope outwardly and oppositely from the back surface t the front surface of the mounting plate. A cover 118 is adapted to be demountably placed over the flag raising mechanism 16 when it is in the non-use state so that people working, playing, or otherwise moving about the boat 10 will not be hurt should they accidentally hit the mechanism. The cover 118 has a front surface 119, opposed side surfaced 120 and 121 and a top surface 122, and is otherwise open. The extending free edges of the opposed side surfaces 120 and 121 are bent inwardly as at 124 so that the cover can be slid downwardly in the direction of arrow 126 onto the flag raising mechanism 16. as seen best in FIG. 5, when the cover 118 is installed on the mechanism 16, the inwardly bent edges 124 of the cover are in hooked over engagement with the beveled side edges 114 and 116 of the mounting plate 26.

From the above, it will be readily apparent that the above described skier signal flag apparatus 14 provides a relatively simple and highly reliable structure which holds the signal flag down when a water skier is being towed by the boat. And, the apparatus automatically raises the flag when the water skier goes down to warn others in the vicinity of the downed skier.

Although the apparatus 14 accomplishes the above, the occupants in the boat, i.e., the boat operator and the required observer, may be less attentive than desired. Therefore, the apparatus 14 may further include a means for providing an audio and/or visual alarm in addition to the flag raising mechanism.

Reference is made once again to FIG. 2 wherein a switch means 130 is provided for electrical operation of any desired audio and/or visual alarm system (not shown). A suitable bracket 132 is mounted on the inner surface of the transom 12 of the boat and a normally open switch 134 is carried on the bracket. The switch is of the type having a spring arm 136 which is normally out of contact with the switch's operating plunger 137 and must be pushed into contact therewith to close the switch 134 by depressing the plunger. An actuator rod 138 is slidably mounted in a bore 139 formed transversely through the transom 12 of the boat and the mounting plate 26 of the flag raising mechanism 16. The actuator rod 138 has its inner end in bearing engagement with the spring arm 136 of the switch 134, and is biased to the extended position. In the extended position, the outer end of the actuator rod 138 protrudes from the mounting plate as shown, and the switch 134 will be in its normally open position. When the water skier falls and the flag assembly 18 is raised, the stud 36 of the pivot means 30 will move into contact with the actuator rod 138 moving it inwardly against the bias of the switch's spring arm 136, thus closing the switch 136 and completing the circuit to the alarm system (not shown).

While the principles of the invention have now been made clear in the illustrated embodiments, there will be immediately obvious to those skilled in the art, many modifications of structure, arrangements, proportionos, the elements, materials, and components used in the practice of the inention, and otherwise, which areparticularly adapted for specific environments and operation requirements without departing from those principles. The appended claims are therefore intended to cover and embrace any such modifications within the limits only of the true spirit and scope of the invention.

What I claim is:

1. A signal flag apparatus for use on a boat that is towing a water skier, said apparatus comprising:

(a) tow line means for coupling to a boat for towing a water skier, said tow line means being taut when tension is applied thereto by the skier and being slack in the absence of skier applied tension;

(b) a flag raising mechanism for mounting on the transom of the boat and including, I. pivot means having a substantially horizontal first position and a substantially vertical second position, II. biasing means for yieldably urging said pivot means to the second position thereof;

(c) a flag assembly demountably connected to said pivot means for movement therewith; and (d) coupling cable means for connection between said pivot means and said tow line means for moving said pivot means to its first position when tension is applied to said tow line means and allowing said biasing means to move said pivot means to its second position when the tension is removed from said tow line means, said cable coupling means including, I. a leader line having one end connected to said pivot means and having an opposite end, II. a first pulley means mounted on said flag raising mechanism below said pivot means, said first pulley means being adapted for free swivel movement and having said leader line in engagement therewith, III. an elongated cable having an intermediate loop formed therein to separate it into an extension cable segment having an extending end and a control cable segment having an extending end, IV. means on the extending end of the extension cable segment of said elongated cable for demountable connection to the boat, V. a second pulley means connected to the extensio cable segment of said elongted cable proximate the extending end thereof, said second pulley means being adapted for free swivel movement and having the control cable segment of said elongated cable in engagement therewith, and VI. means on the extending end of the control cable segement of said elongated cable for demountable connection to the opposite end of said leader line.

2. A signal flag apparatus as claimed in claim 1 wherein said tow line means comprises a skier tow rope having an inboard end for demountable connection to the loop of said elongated cable.

3. The combination of a water skier tow boat having an apparatus for automatically raising a warning flag when a water skier falls, the combination comprising:

(a) a water skier tow boat having a transom;

(b) tow line means coupled to the transom of said boat for towing a water skier, said tow line means being taut when tension is applied thereon by the skier and being slack in the absence of skier applied tension;

(c) a flag raising mechanism mounted on the transom of said boat, said flag raising mechanism being biased to a first substantially vertical position and movable to a second substantially horizontal position, said flag raising mechanism including, I. a mounting plate attached to the transom of said boat, II. a shaft carried on said mounting plate and journaled for rotation about a substantially horizontal axis, III. a stud on said shaft for movement therewith, said stud extending normally from said shaft, and IV. biasing means for yieldably urging said shaft and said stud into a first position wherein said stud extends upwardly from said shaft;

(d) a flag assembly demountably connected to said flag raising mechanism for movement therewith; and (e) coupling cable means connected between said flag raising mechanism and said tow line means for moving and holding said flag raising mechanism in its second position when tension is applied to said tow line means by the water skier and allowing said flag raising mechanism to be biasingly moved to its first position when the skier falls, said coupling cable means including, I. a leader line having one end connected to said stud and having an opposite end, II. first pulley means mounted on said mounting plate below said shaft, said first pulley means being free for swivel movement and having said leader line in engagement therewith, III. an elongated cable having an intermediate loop formed therein to separate it into an extension cable segement having an extending end and a control cable segement having an extending end, IV. means on the extending end of the extension cable segment of said elongated cable for demountable connection to the transom of said boat, V. second pulley means connected to the extension cable segment of said elongated cable proximate the extending end thereof, said second pulley means having free for swivel movement and having the control cable segment of said elongated cable in engagement thereiwht, and VI. means on the extending end of the control cable segment of said elongated cable for demountable connecteion to the opposite end of said leader line.

4. The combination of claim 3 wherein said tow line means comprises a skier tow rope having an inboard end demountably connected to the intermediate loop of said elongated cable.

5. A signal flag apparatus for use on a boat that is towing a water skier, said apparatus comprising:

(a) tow line means for coupling to a boat for towing a water skier, said tow line means being taut when tension is applied thereto by the skier and being slack in the absence of skier applied tension, said tow line means including, I. an extension cable having an inboard end for demountable connection to the boat end having an outboard end, II. a skier tow rope demountably connectable to the outboard end of said extension cable;

(b) a flag raising mechanism for mounting on the transom of the boat and including, I. pivot means having a substantially horizontal first position and a substantially vertical second position, II. biasing means for yieldably urging said pivot means to the second position thereof;

(c) a flag assembly demountably connected to said pivot means for movement therewith; and (d) coupling cable means for connection between said pivot means and said tow line means for moving said pivot means to its first position when tension is applied to said tow line means and allowing said biasing means to move said pivot means to its second position when the tension is removed from said tow line means, said cable coupling means including, I. a leader line having one end connected to said pivot means and having an opposite end, II. a first pulley means mounted on said flag raising mechanism below said pivot means, said first pulley means being adapted for free swivel movement and having said leader line in engagement therewith, III. a control cable having means on one end for demountable connection to the opposite end of said leader line, said control cable having an extending end, IV. a second pulley means connected to said extension cable proximate the inboard end thereof, said second pulley means being adapted for free swivel movement and having said control cable in engagement therewith, and V. means on said extension cable for fixedly attaching the extending end of said control cable to said extension cable proximate the outboard end thereof.

6. The combination of a water skier tow boat having an apparatus for automatically raising a warning flag when a water skier falls, the combination comprising:

(a) a water skier tow boat having a transom;

(b) a skier tow rope coupled to the transom of said boat for towing a water skier, said skier tow rope being taut when tension is applied thereon by the skier and being slack in the absence of skier applied tension;

(c) a flag raising mechanism mounted on the transom of said boat, said flag raising mechanism being biased to a first substantially vertical position and movable to a second substantially horizontal position, said flag raising mechanism including, I. a mounting plate attached to the transom of said boat, II. a shaft carried on said mounting plate and journaled for rotation about a substantially horizontal axis, III. a stud on said shaft for movement therewith, said stud extending normally from said shaft, and IV. biasing means for yieldably urging said shaft and said stud into a first position wherein said stud extends upwardly from said shaft;

(d) a flag assembly demountably connected to said flag raising mechanism for movement therewith; and (e) coupling cable means connected between said flag raising mechanism and said skier tow rope for moving and holding said flag raising mechanism in its second position when tension is applied to said skier tow rope by the water skier and allowing said flag raising mechanism to be biasingly moved to its first position when the skier falls, said cable coupling means including, I. a leader line having one end connected to said stud and having an oppsoite end, II. first pully means mounted on said mounting plate below said shaft, said first pulley means being free for swivel movement and having said leader line in engagement therewith, III. a control cable having one end demountably connected to the opposite end of said leader line, said control cable having an extending end, IV. second pulley means connected to said skier tow rope proximate the inboard end thereof, said second pulley means being free for swivel movement and having said control cable in engagement therewith, and V. means on said skier tow rope for fixed attachment of the extending end of said control cable to said skier tow rope in spaced relationship with the inboard end thereof.

7. A signal flag apparatus for use on a boat that is towing a water skier, said apparatus comprising:

(a) a skier tow rope for coupling to a boat for towing a water skier, said skier tow rope being taut when tension is applied thereto by the skier and being slack in the absence of skier applied tension;

(b) a flag raising mechanism for mounting on the transom of the boat and including, I. pivoting means having a substantially horizontal first position and a substantially vertical second position, II. biasing means for yieldably urging said pivot means to the second position thereof;

(c) a flag assembly demountably connected to said pivot means for movement therewith; and (d) coupling cable means for connection between said pivot means and said skier tow rope for moving said pivot means to its first position when tension is applied to said skier tow rope and allowing said biasing means to move said pivot means to its second position when the tension is removed from said skier tow rope, said cable coupling means including, I. a leader line having one end connected to said pivot means and having an opposite end, II. a first pulley means mounted on said flag raising mechanism below said pivot means, said first pulley means adapted for free swivel movement and having said leader line in engagement therewith, III. a control cable having means on one end for demountable connection to the oppsoite end of said leader line, said control cable having an extending end, IV. a second pulley means for connection to said skier tow rope proximate the inboard end thereof, said second pulley means adapted for free swivel movement and having said control cable in engagement therewith, and V. means on said skier tow rope for fixedly attaching the extending end of said control cable to said skier tow rope in spaced relationship with the inboard end thereof.

8. A signal flag apparatus as claimed in claim 7 wherein said flag raising mechanism comprises:

(a) a mounting plate for mounting on a transom of the boat;

(b) said pivot means being mounted on said mounting plate and including,

I. a shaft journaled for rotation about a horizontal axis on said mounting plate, II. a stud extending integrally and normally from said shaft and having an extending end; and (c) said biasing means being a torsion spring that is mounted on said shaft and having a first end in bearing engagement with said mounting plate and a second end in biasing engagement with said stud.

9. A signal flag apparatus as claimed in claim 8 wherein said flag assembly comprises:

(a) an elongated standard having first and second ends;

(b) a signal flag on the first end of said standard; and (c) coupling means on the second end of said standard for demountable connection to the extending end of said stud.

10. A signal flag apparatus as claimed in claim 9 wherein said signal flag assembly further comprises a bumper means on said standard to protect the boat when said pivot means moves from its first position to its second position.

11. A signal flag apparatus as claimed in claim 8 and further comprising a cover means for demountable placement on said flag raising mechanism when said flag assembly and said coupling cable means are disconnected therefrom.

12. A safety flag apparatus as claimed in claim 7 and further comprising an electric switch means for mounting on the boat proximate said pivot means so as to be out of operable engagement with said pivot means when said pivot means is in its first position and in operable engagement with said pivot means when it is in its second position, said switch means having a first state when said pivot means is out of engagement therewith and a second state when said pivot means is in engagement therewith.

13. A signal flag apparatus as claimed in claim 7 and further comprising:

(a) an extension cable having an inboard end for demountable connection to the boat and having an outboard end; and (b) said skier tow rope being demountably connected to the outboard end of said extension cable.

14. The combination of a water skier tow boat having an apparatus for automatically raising a warning flag when a water skier falls, the combination comprising:

(a) a water skier tow boat having a transom;

(b) tow line means coupled to the transom of said boat for towing a water skier, said tow line means being taut when tension is applied thereon by the skier and being slack in the absence of skier applied tension,s aid tow line means including, I. an extension cable having an inboard end demountably connected to the transom of said boat and having an outboard end, and II. a skier tow rope demountably connected to the outboard end of said extension cable;

(c) a flag raising mechanism mounted on the transom of said boat, said flag raising mechanism being biased to a first substantially vertical position and movable to a second substantially horizontal position, said flag raising mechanism including, I. a mounting plate attached to the transom of said boat, II. a shaft carried on said mounting plate nad journaled for rotation about a substantially horizontal axis, III. a stud on said shaft for movement therewith, said stud extending normally from said shaft and IV. biasing means for yieldably urging said shaft and said stud into a first position wherein said stud extends upwardly from said shaft;

(d) a flag assembly demountably connected to said flag raising mechanism for movement therewith; and (e) coupling cable means connected between said flag raising mechanism and said tow line means for moving and holidng said flag raising mechanism in its second position when tension is applied to said tow line means by the water skier and allowing said flag raising mechanism to be biasingly moved to its first position when the skier falls, said coupling cable means including, I. a leader line having one end connected to said stud and having an opposite end, II. first pulley means mounted on said mounting plate below said shaft, said first pulley means being free for swivel movement and having said leader line in engagement therewith, III. a control cable having one end demountably connected to the opposite end of said leader line and having an extending end, IV. second pulley means connected to said extension cable proximate the inboard end thereof, said second pulley means being free for swivel movement and having said control cable in engagement therewith, and V. means on said extension cable for fixed attachment of the extending end of said control cable to said extension cable proximate the outboard end thereof.

* * * * *